United States Patent [19]

Phillips et al.

[11] Patent Number: 4,787,105

[45] Date of Patent: Nov. 29, 1988

[54] SLEEPING BAG WITH SNORKEL HOOD AND DRAFT CURTAIN

[75] Inventors: James G. Phillips, Pleasant Grove; Gordon K. Scott, Orem, both of Utah

[73] Assignee: Burlington Industries, Inc., Greensboro, N.C.

[21] Appl. No.: 12,954

[22] Filed: Feb. 10, 1987

[51] Int. Cl.[4] ..... A47G 9/08

[52] U.S. Cl. ..... 5/413; 128/201.13; 2/69.5

[58] Field of Search ..... 5/413, 414, 416, 474; 2/69.5, 69; 128/201.13, 205.26

[56] References Cited

U.S. PATENT DOCUMENTS

| | | | |
|---|---|---|---|
| 598,995 | 2/1898 | Jacob . | |
| 983,223 | 1/1911 | Fitch | 2/69.5 |
| 1,039,509 | 9/1912 | Gail | 5/413 |
| 1,267,551 | 5/1918 | Jacobs | 5/413 |
| 1,699,002 | 1/1929 | Leibold . | |
| 2,324,665 | 7/1943 | Ayres . | |
| 2,338,226 | 1/1944 | Bauer . | |
| 2,368,220 | 1/1945 | Hinds . | |
| 2,537,537 | 1/1951 | Ljungberg . | |
| 2,555,051 | 5/1951 | Miller | 2/69.5 |
| 2,628,358 | 2/1953 | Neils . | |
| 2,915,074 | 12/1959 | Cameto | 52/2 |
| 3,000,379 | 9/1961 | Viers | 128/205.26 |
| 3,326,214 | 6/1967 | McCoy | 128/201.13 |
| 3,717,888 | 2/1973 | Phelan | 5/416 |
| 3,831,206 | 8/1974 | Geary . | |
| 4,192,030 | 3/1980 | Casson . | |
| 4,671,268 | 6/1987 | Hunt | 128/201.13 |

FOREIGN PATENT DOCUMENTS

| | | | |
|---|---|---|---|
| 109851 | 4/1900 | Fed. Rep. of Germany | 5/416 |
| 2516781 | 10/1976 | Fed. Rep. of Germany | 5/413 |
| 1136521 | 12/1956 | France | 128/205.26 |
| 2285105 | 4/1976 | France | 5/413 |
| 2665 | 2/1908 | United Kingdom | 5/416 |

OTHER PUBLICATIONS

"Quality Recreation Equipment", Cozy Vip Brochure.
"Fieldbook", Boy Scouts of America, pp. iv, v, 76–79, 342–347.

*Primary Examiner*—Alexander Grosz
*Assistant Examiner*—Eric K. Nicholson
*Attorney, Agent, or Firm*—Nixon & Vanderhye

[57] ABSTRACT

A sleeping bag has upper and lower portions, an access opening in the upper portion, and a breathing opening in the upper portion adjacent one end of the bag. Overlying and spaced from the breathing opening is a snorkel hood where outgoing exhalation is placed in heat and moisture exchange relation with incoming air so that an individual wholly enclosed within the bag may breathe preheated air having substantial moisture content. A curtain is provided along the upper portion adjacent the access opening for engaging about the upper torso of the individual and with the lower portion of the bag to divide and seal the bag into head and body compartments. In warm and cool weather conditions, the individual may sleep with his head exposed to ambient air. In warm weather conditions, the curtain underlies the upper portion above the individual's torso so that air may circulate into the body compartment. In cool weather conditions, the curtain is engaged about the individual's torso to maintain body warmth in the sealed body compartment. In cold weather conditions, the individual's head and torso lie wholly within the head and body compartments with the curtain drawn about the torso to seal and divide the compartments.

5 Claims, 3 Drawing Sheets

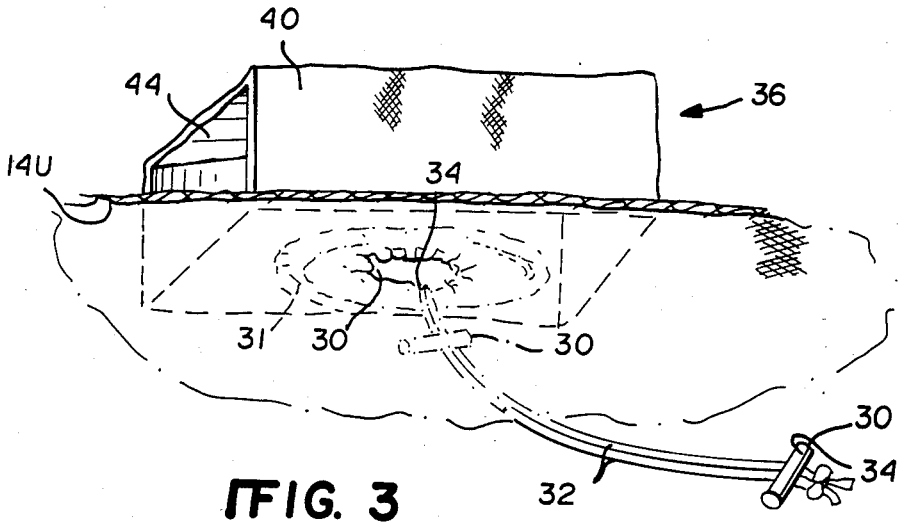
FIG. 3
FIG. 4
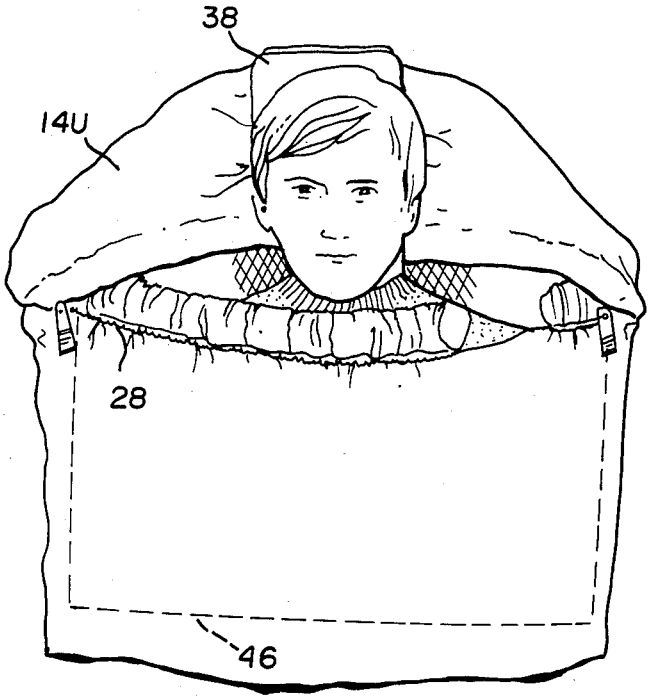

SLEEPING BAG WITH SNORKEL HOOD AND DRAFT CURTAIN

BACKGROUND OF THE INVENTION

The present invention relates generally to sleeping bags and particularly to sleeping bags useful over a wide temperature range.

Sleeping bags are generally constructed for use in two different ways. Certain bags allow an individual to sleep with his head outside the bag, fully exposed to the environment. Thus, in warm or cool weather conditions, the individual may directly breathe fresh air. Other sleeping bags are constructed such that the individual may sleep completely inside the bag. In these latter constructions, the sleeping bag is formed of materials having a high level of air porosity enabling the air to easily defuse through the bag. In using either of these types of bags, however, an individual may suffer significant body heat loss, discomfort and cold injury. Also, those bags lack any type of humidity control.

Additionally, the operational temperature range of both types of bags is limited. For example, the open-type bag may not be useful in extreme cold weather conditions. Conversely, the closed bag may not be useful under warm conditions. Heat loss, humidity control and comfort can also be significant problems when using those bags. For example, when an individual sleeps with his or her head outside the bag and breathes bitter cold air, it can be quite uncomfortable, as well as a source of tremendous heat loss, possibly resultig in cold injury. On the other hand, while sleeping wholly within the bag promotes comfort and curtails heat loss, humidity levels may occur which could create undesirable condensation in certain areas within the sleeping bag. Humidity control is extremely important. Dehydration of the body and potential hypothermia because of respiration loss of moisture through the lungs can be very serious problems in extreme cold weather. Such moisture loss must be compensated for from another source and that, in turn, may create an additional problem in certain environments.

SUMMARY OF THE INVENTION

According to the present invention, there is provided a novel and improved sleeping bag having improved humidity control, comfort and heating characteristics, as well as being useful over a wide temperature range. In one aspect of the present invention, there is provided a sleeping bag having an elongated body formed of a material having low air porosity and having means defining an opening for allowing a person to breathe therethrough. A snorkel hood is carried by the body and disposed over the opening, the snorkel hood having a closed top and side walls for preventing entry of precipitation into the opening and additionally having at least one open side for allowing outside air to enter the opening. The snorkel hood is preferably formed of a material having sufficient flexibility such that it may be collapsed but also having sufficient rigidity so that the snorkel hood may be self-supporting over the opening. When an individual lies wholly within the sleeping bag of the present invention, the snorkel provides a low-resistance path for breathing through the bag opening, thereby avoiding stuffiness within the bag, and affords a path for expelling humidity from the bag. The snorkel also functions beneficially as a heat exchanger because of its substantial cross-sectional area. That large cross-sectional area enables the incoming air to move through the snorkel slowly for mixing and heat exchange with the outgoing air such that the individual breathes preheated air rather than extremely cold air. This is significant because breathing cold air can be uncomfortable and the otherwise unrecaptured heat in the exhaled air represents a tremendous heat loss. Thus, the snorkel acts as a heat exchanger which recoups or recaptures part of the heat lost through breathing, enhances the overall effectiveness of the sleeping bag system of the present invention by improving the comfort level of the individual sleeping in the bag and keeps the inside of the bag from becoming excessively stuffy or highly humid. Another feature of the invention resides in the ability to control the size of the opening. In this manner, the amount of air communicating with the inside of the sleeping bag can be modulated for personal comfort and taste.

According to another significant aspect of the present invention, control of the humidity within the bag is provided. In this embodiment, the sleeping bag comprises an elongated body formed of a material having low air porosity and having means defining a breathing opening adjacent one end. The body has upper and lower surfaces and an access opening in its upper surface enabling ingress and egress by an individual into and out of the bag body. A curtain is connected to the upper surface of the body adjacent the access opening and extends substantially transversely of the body intermediate its ends such that an individual may lie in the bag body with the curtain drawn about the upper portion of his torso. The curtain thus divides the bag body into longitudinally spaced first and second compartments substantially sealed one from the other. The breathing opening lies in the first compartment containing the individual's head, whereby the individual may breathe within the bag. By using the curtain to divide the head area from the rest of the bag, i.e., the first compartment from the second compartment, the moisture from the the individual's breath will not permeate the entire bag but will be trapped substantially in the head or first compartment area. This maintains low humidity in the remainder of the bag. The curtain thus avoids migration of humidity into the lower areas of the bag, avoids condensation in those areas, and enables concentration of the majority of the moisture in the head area of the bag, more easily ensuring its exit through the snorkel hood.

Additionally and importantly, by concentrating the moisture in the head compartment, some of the humidity can be recovered for rebreathing. In the heat exchange process in the snorkel hood, the incoming dry air will pick up some of the moisture in the outgoing air, thus preventing the head area in the sleeping bag from becoming extremely dry. It consequently reduces the moisture loss from the individual's body, reduces the water requirements for the individual, and avoids or minimizes the potential for dehydration.

It will also be appreciated that another important feature of the present invention resides in the integration into a single sleeping bag of a snorkel hood and a curtain, each having the foregoing described features, which, combined, produce very advantageous results. By providing the snorkel hood and draft curtain together in the sleeping bag system, they work in concert to reduce the moisture requirements for the body, improve survivability and livability, particularly in cold weather environments, and ward off hypothermia.

As indicated previously, the sleeping bag of the present invention is useful over a wide temperature range. For example, in warm weather conditions, the curtain may be disposed to underlie the upper surface of the bag above an individual in the bag and the head compartment of the bag may be collapsed such that the head of the individual may rest on the hood, using the latter as a pillow. In this manner, the lower compartment of the bag is open through the access opening allowing air to circulate into the body area. In cool weather conditions, the individual may be similarly situated in the bag but with the draft curtain drawn about the individual's neck and shoulders, substantially sealing off the lower portion or compartment of the bag. Thus, cool air is prevented from entering that lower compartment. In cold weather conditions, the individual may lie wholly within the bag with the access opening zippered shut. Similarly as in the cool weather conditions, the curtain is drawn about the neck and shoulders of the individual, dividing the bag into upper and lower compartments. However, air flow is provided in this usage to the head compartment through the snorkel hood and, as indicated previously, heat and humidity are exchanged, providing preheated, somewhat moist, air to the head compartment. With the curtain sealing off the lower compartment, such compartment would be substantially warmer than if open to the head compartment.

Accordingly, it is a primary object of the present invention to provide a novel and improved sleeping bag having improved temperature and humidity control and useful over a wide range of temperatures. This and further objects and advantages of the present invention will become more apparent upon reference to the following specifications, appended claims and drawings.

BRIEF DESCRIPTION OF THE DRAWINGS

FIG. 3 is an enlarged fragmentary perspective view illustrating the breathing opening in the upper surface of the head compartment; and FIGS. 4 through 6 are enlarged fragmentary plan views of the sleeping bag illustrating its manner of use in warm, cool and cold weather conditions, respectively.

DETAILED DESCRIPTION OF THE DRAWINGS

Reference will now be made in detail to a preferred embodiment of the present invention, an example of which is illustrated in the accompanying drawings.

Figure 1:
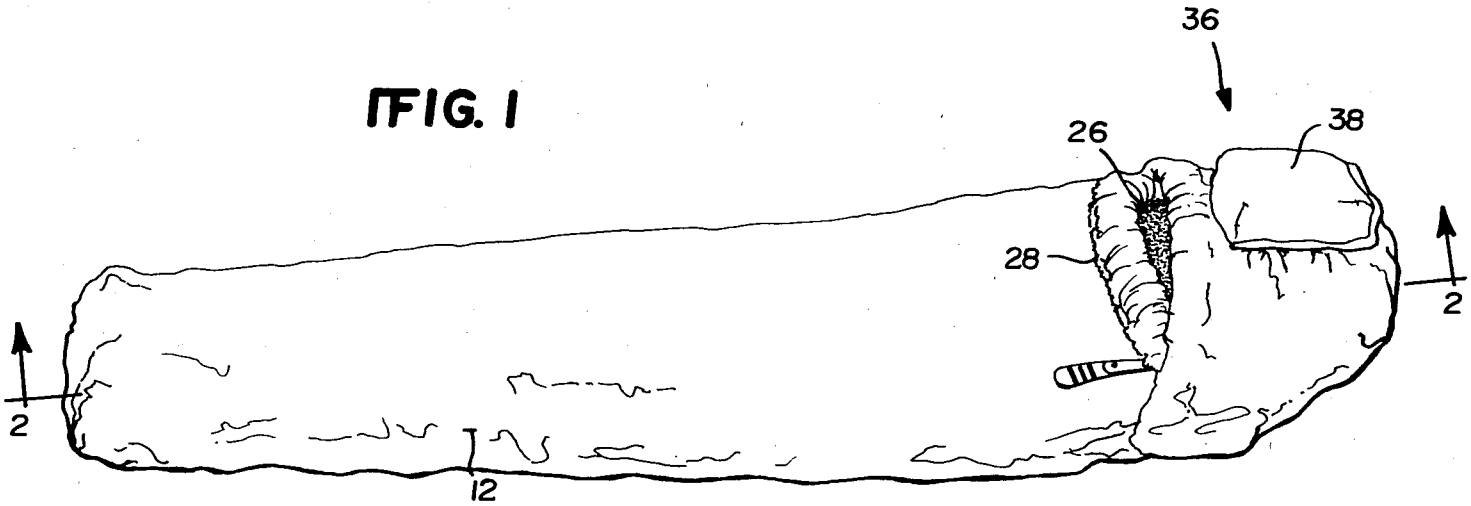
FIG. 1 is a perspective view of a sleeping bag constructed in accordance with the present invention and illustrated in the open condition.

In FIG. 1, there is shown a sleeping bag, generally designated 10, comprised of an elongated envelope or body 12 formed of a non-inflatable fabric that has low air porosity. Body 12 may be formed in any convenient manner and the precise manner of its construction forms no part of the present invention, except to the extent otherwise indicated herein. Body 12 has upper and lower portions 14L and 16L, respectively, in part defining, with side walls 18 and end wall 20, a lower or body compartment 22. At the opposite end of the body 12, upper and lower portions 14U and 16U together with side walls 19 and end wall 21 define an upper or head compartment 24. An access opening 26 is provided in the upper surface 14L adjacent the juncture of the body and head compartments 22 and 24, respectively. Opening 26 may be opened or closed by means of a zipper or other means of fastening such as snaps, velcro, etc. 28 interconnecting the upper portions 14L and 14U of the head and body compartments, respectively. Thus, opening 26 provides for ingress and egress by an individual respectively into and out of sleeping bag 10.

An expansible opening 30 is formed in the upper portion 14U of the body 12 through which air communicates into the head compartment 24 for purposes of enabling an individual to breathe freely when lying wholly within the bag, as described hereinafter. The expansible opening 30 is provided with a drawstring 32 for expanding and contracting the opening 30, whereby its size may be selected as desired. The drawstring extends through fabric folded over onto itself (31) to form the opening and which folded fabric may be gathered to a greater or lesser extent to open and close the opening 30, respectively. A holder 34 is provided on the opposite ends of drawstring 32 to facilitate pulling the drawstring. Thus, by pulling on the drawstring, the opening may be reduced in size and by manually spreading the fabric defining the margins of opening 30, the opening can be enlarged as desired.

In accordance with the present invention, there is provided a snorkel hood, generally designated 36, disposed over the breathing opening 30. Snorkel hood 36 preferably has a closed top 38, oppositely disposed side walls 40, an end wall 42 and an opening 44 opposite end wall 42. The snorkel hood 36 is preferably formed of a laminate of a fabric and a foam material. The laminate has sufficient pliability such that the snorkel hood 36 may be collapsed but also has sufficient rigidity so that the snorkel hood may be self-supporting over the opening as illustrated. It will be appreciated that the snorkel hood prevents the ingress of precipitation, as well as minimizes drafts from wind blowing into the head compartment 24 through the opening 30.

Figure 2:
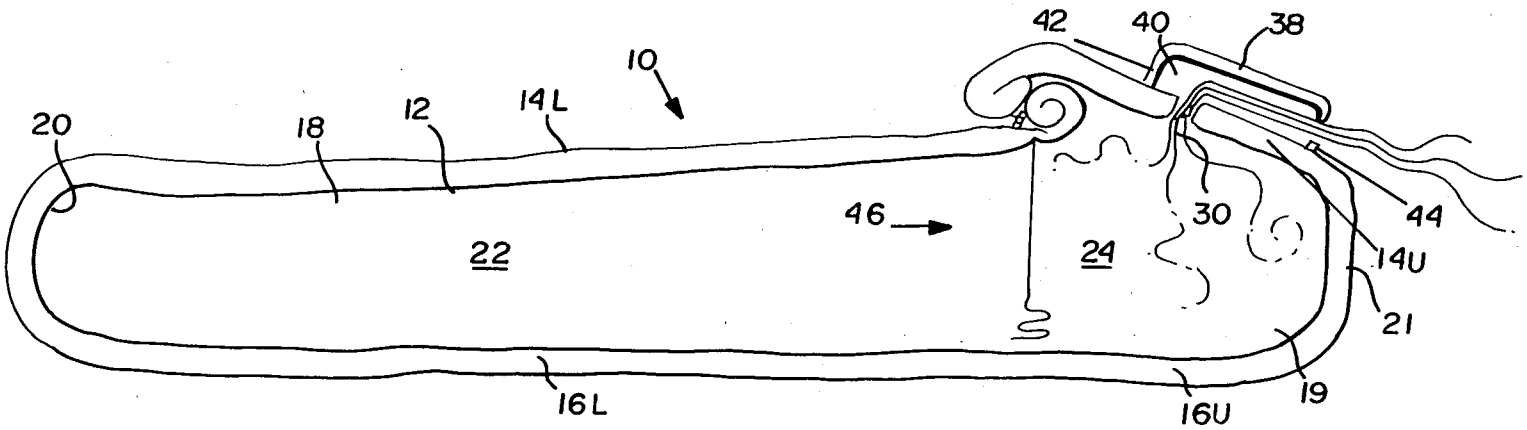
FIG. 2 is a longitudinal cross-sectional view of the sleeping bag taken generally about on lines 2—2 in FIG. 1.

Referring now to FIG. 2, there is illustrated a draft curtain, generally designated 46, which is secured to the upper portion 14 of body 12 and extends transversely of the body from side to side. As will be seen from a comparison of FIGS. 2 and 4, curtain 46 extends from its securement to upper portion 14L a depth, when freely hanging from upper surface 14L, at least sufficient to engage the lower surface 16 of body 12 when an individual lies within the sleeping bag 10. Preferably, curtain 46 is formed of a low air permeable fabric, such as Versatech. The material also preferably has a high moisture permeability.

Figure 5:
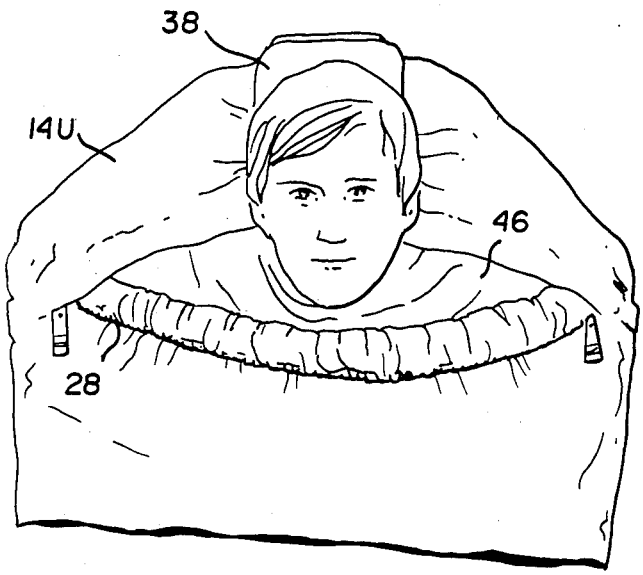
Figure 6:
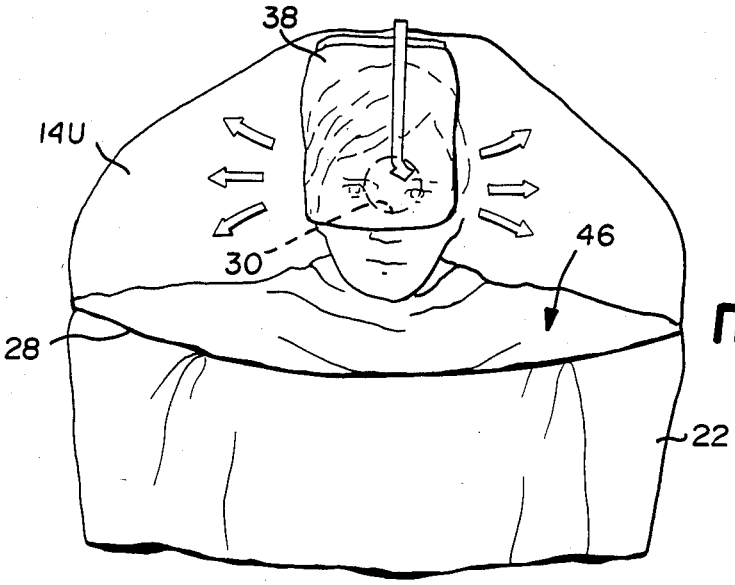

As an indication of the capacity of the sleeping bag of the present invention for use over a wide temperature range, its use will be described in conjunction with FIGS. 4 through 6, which illustrate use of the bag in warm, cool and cold weather conditions, respectively. Referring now to FIG. 4, an individual may step into the sleeping bag such that the portion of his torso below the neck resides in the body compartment 22. In view of the warm weather conditions, the upper surface 14L including the snorkel hood of the head compartment is collapsed against the lower surface 16U, whereby the individual's head may rest on the top of the snorkel hood and be exposed to the environment. Note that the curtain illustrated in dashed lines in FIG. 4 lies along the underside of the upper surface, generally on top of the individual but not in position to seal the body compartment. The draft curtain (46) may also be positioned outside and lying on top of the body compartment (14L). Thus, the body compartment 22 is open and air is allowed to circulate into that body compartment area.

Under cool weather conditions where greater warmth is necessary, the individual may climb into the bag similarly as previously described. in this case, the draft curtain 46 is pulled down about the upper portions of the individual's torso. Particularly, the draft curtain is drawn about the individual's neck and shoulders, thus substantially sealing the body compartment 22 and preventing ingress of cool air. Of course, depending upon temperature conditions, the individual may also lie with his head within the head compartment 24, leaving the access opening unzippered but with the curtain drawn about the upper portions of his torso.

In cold weather conditions, the sleeping bag is zippered closed and draft curtain 46 is pulled or drawn around the neck and shoulders of the individual's torso, thus dividing the bag into two discrete compartments, i.e., the head and body compartments 24 and 22, respectively. Because the body compartment is sealed off, it will be warmer than the head compartment inasmuch as the head compartment receives cool air through the snorkel hood and opening. As will be recalled, the cold air is drawn in through the snorkel hood, where it is in heat and moisture exchange relation with the outgoing exhalation. This permits the individual to breathe moist preheated air, while at the same time expelling substantial moisture from the head compartment and totally avoiding moisture accumulation in the body compartment.

It will thus be seen that according to the present invention a sleeping bag is provided which affords temperature and humidity control, as well as providing for its use over a wide temperature range. While the invention has been herein shown and described in what is presently conceived to be the most practical and preferred embodiment thereof, it will be apparent to those of ordinary skill in the art that many modifications may be made thereto within the scope of the present invention, which scope is to be accorded the broadest interpretation of the appended claims so as to encompass all equivalent apparatus.

We claim:

1. A sleeping bag comprising:

an elongated body having upper and lower portions and formed of a material having low air porosity, said body having means defining an opening in said upper portion for allowing a person to breathe therethrough but not of a size providing for access into said body by such person;

means separate from said breathing opening and providing an access opening in said upper portion enabling access into said body by such person;

a snorkel hood carried by said body and disposed over said breathing opening, said snorkel hood having top and side walls closing said hood for preventing entry of precipitation into said opening, said snorkel hood also having at least one open side for allowing outside air to enter said breathing opening, said snorkel hood being formed of a material having sufficient pliability so that the snorkel hood may be collapsed but also having sufficient rigidity so that said snorkel hood may be self-supporting over said breathing opening.

2. A sleeping bag according to claim 1 including means for expanding and contracting said breathing opening for controlling its size.

3. A sleeping bag according to claim 2 wherein said expanding and contracting means includes a drawstring.

4. A sleeping bag according to claim 1 wherein said body has upper and lower protions, a curtain extending from said upper portion substantially transversely of said body intermediate its ends such that an individual may lie in said body with said curtain drawn about the upper portion of the individual's torso to divide said body into first and second compartments substantially sealed one from the other and with said first compartment containing the individual's head, said breathing opening means lying in said body in communication with said first compartment.

5. A sleeping bag according to claim 4 wherein said access opening lies in the upper body portion, said curtain being secured to the upper portion of said body adjacent said access opening, said curtain extending away from said upper surface sufficiently to engage the lower portion of said body and to be gathered about the individual's neck and underneath his shoulder when lying on his back and thereby substantially seal said compartments one from the other.

* * * * *